US005815944A

United States Patent [19]

Palmer

[11] Patent Number: 5,815,944

[45] Date of Patent: Oct. 6, 1998

[54] ENCLOSURE FOR DRYING AND STORING HOSIERY AND METHOD OF USE

[76] Inventor: James R. Palmer, 15421 Waywood Ave., Baton Rouge, La. 70816

[21] Appl. No.: 731,594

[22] Filed: Oct. 16, 1996

[51] Int. Cl.[6] ..... F26B 19/00

[52] U.S. Cl. ..... 34/202; 34/233; 34/473; 219/385

[58] Field of Search ..... 34/80, 90, 91, 34/95, 202, 233, 473, 81; 219/385

[56] References Cited

U.S. PATENT DOCUMENTS

| | | | |
|---|---|---|---|
| 2,831,268 | 4/1958 | Cox | 34/81 |
| 4,199,873 | 4/1980 | Hansen et al. | 34/202 |
| 4,856,206 | 8/1989 | Klein | 34/151 |
| 5,369,893 | 12/1994 | Perito | 34/239 |
| 5,620,622 | 4/1997 | Lang | 219/385 |

*Primary Examiner*—Henry A. Bennett
*Assistant Examiner*—Pamela A. O'Connor
*Attorney, Agent, or Firm*—John F. Sieberth; R. Andrew Patty, II

[57] ABSTRACT

Described are a device and methods for drying hosiery and other articles of clothing in a way which is aesthetically pleasing and efficient. In one embodiment, the invention provides an enclosure comprising a bottom portion; suspending means disposed above the bottom portion for hanging the hosiery and/or other articles of clothing within the enclosure; absorption means which, during normal use, is disposed above the bottom portion and below the hosiery and/or other articles of clothing when hung within the enclosure, for absorbing liquid which may drop from the hosiery and/or other articles of clothing when wet; and attachment means for attaching the enclosure to a substantially vertical surface; whereby the hosiery and/or other articles of clothing may be stored to dry while remaining substantially concealed within the enclosure. In a preferred embodiment, the device further comprises a front portion and two lateral sides, wherein the front portion comprises one or more doors, each of the doors having a hinge side pivotally hinged to a respective lateral side of the enclosure so that, when in a closed position, the doors extend between the lateral sides to substantially conceal the contents of the enclosure.

20 Claims, 4 Drawing Sheets

ENCLOSURE FOR DRYING AND STORING HOSIERY AND METHOD OF USE

TECHNICAL FIELD

This invention relates to enclosures for drying and storing articles of clothing, and in particular hosiery, as well as to the use of such enclosures.

BACKGROUND

Many types of clothing cannot be dried in conventional clothes dryers without becoming prematurely worn or otherwise damaged. Accordingly, many who own such delicate clothing resort to drip-drying, which often requires the area below the wet clothing to be water resistant and configured to store or dispose of falling liquid. These circumstances have given rise to a common household problem which involves drying this type of clothing outside of the view of other residents and visitors to the household. To many persons, hosiery, underwear, bathing suits and other articles of clothing hanging from shower stalls, shower curtain rails or bathroom towel racks creates an unsightly appearance.

Thus, a need exists for an efficient and practical way to dry wet clothing, including delicate items such as hosiery, without placing the clothing in the open and in plain view of household residents or visitors.

SUMMARY OF THE INVENTION

This invention fulfills this need by providing, among other things, a device which is easy to install, requires no power source, is configured to handle moisture from wet clothing, and is capable of providing storage area as well. Moreover, the device need not be confined to usage in bathrooms or laundry rooms of households as it can be used in any suitable location having a suitable wall or door surface without danger of causing wet floors or other adverse consequences of dripping water on furniture, flooring, carpeting or the like. In particular, this invention provides an enclosure for drying hosiery and/or other articles of clothing, the enclosure comprising a bottom portion; suspending means disposed above the bottom portion for hanging the hosiery and/or other articles of clothing within the enclosure; absorption means which, during normal use, is disposed above the bottom portion and below the hosiery and/or other articles of clothing when hung within the enclosure, for absorbing liquid which may drop from the hosiery and/or other articles of clothing when wet; and attachment means for attaching the enclosure to a substantially vertical surface; whereby the hosiery and/or other articles of clothing may be stored to dry while remaining substantially concealed within the enclosure.

This invention also provides a method of drying hosiery and/or other articles of clothing. The method comprises placing the hosiery and/or other articles of clothing in an enclosure, the enclosure comprising a bottom portion; suspending means disposed above the bottom portion for hanging the hosiery and/or other articles of clothing within the enclosure; absorption means below the suspending means and above the bottom portion for absorbing liquid which may drop from the hosiery and/or other articles of clothing when wet; and attachment means for attaching the enclosure to an interior surface; whereby the hosiery and/or other articles of clothing may be stored to dry while remaining concealed within the enclosure.

In preferred embodiments, the bottom portion of the device of this invention comprises an upper interior surface at least a portion of which extends through a nonhorizontal plane to thereby prevent excess water or other liquid on the upper interior surface from running off of that surface during normal use.

In addition, this invention provides a method of drying hosiery or like articles of clothing which comprises suspending the articles over an elevated, supported water absorption material in the presence of moving air such that (i) moisture from the articles is allowed to drop to the material and to be absorbed thereby, and (ii) moving air contacting the material vaporizes absorbed water therefrom and removes the resultant water vapor from proximity to the articles. Preferably, the articles, when suspended, are contained by an enclosure which also contains the water absorption material and which substantially conceals the articles from the view of passersby.

These and other embodiments and features of the invention will become still further apparent from the ensuing description, appended claims and accompanying drawings.

BRIEF DESCRIPTION OF THE DRAWINGS

In each of the above figures, like numerals are used to refer to like parts among the several figures.

DETAILED DESCRIPTION OF THE INVENTION

Figure 1:
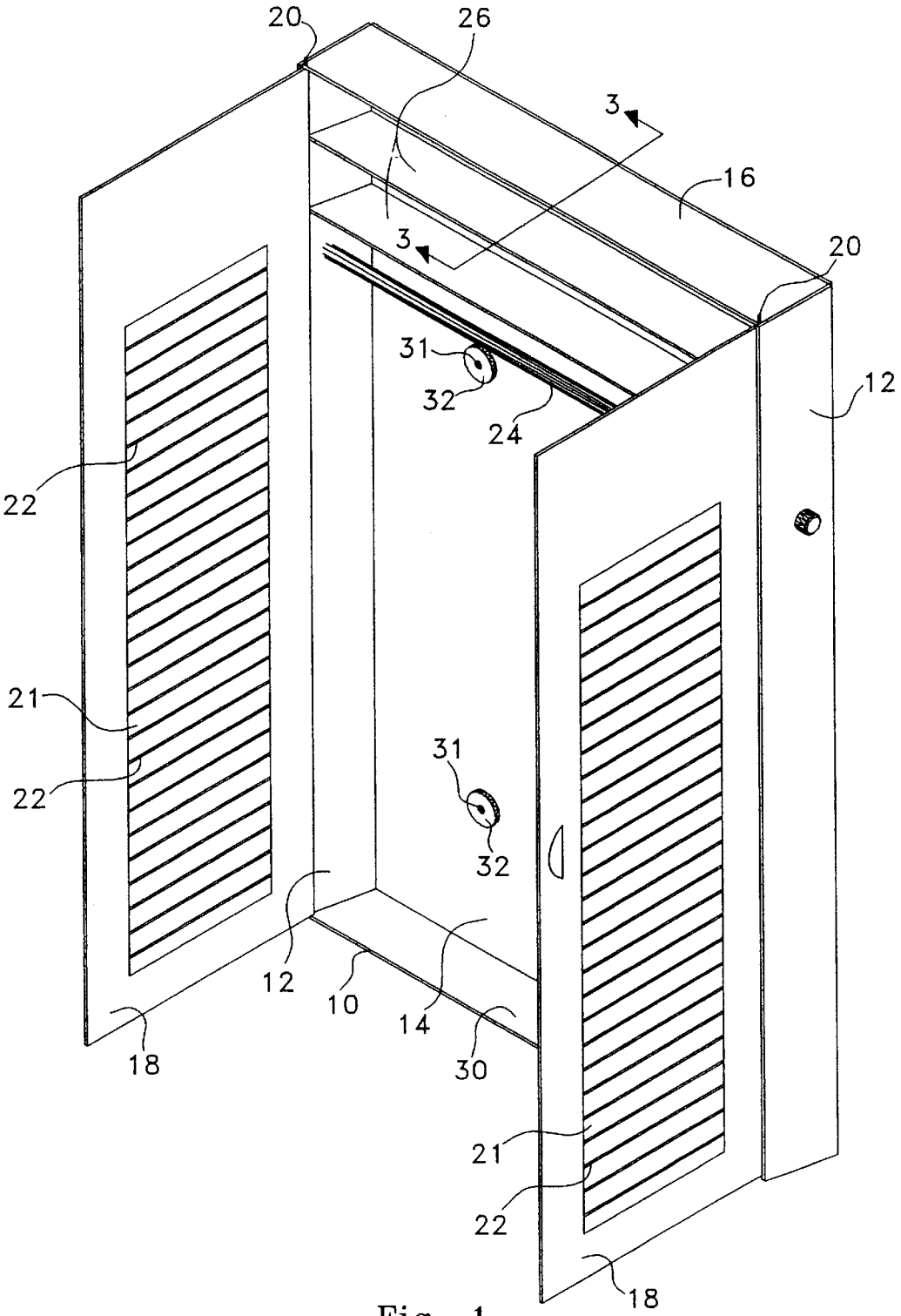
FIG. 1 is a view in perspective of a preferred embodiment of this invention.

As noted previously, this invention provides a device and methods for efficiently drying hosiery and other articles of clothing while preserving the aesthetics of the surrounding environs. With reference to the drawings, FIGS. 1 through 4 illustrate a preferred embodiment of this invention. The device is an enclosure defined by a bottom portion or plate 10, two lateral sides 12, a rear plate 14, a top plate 16 and a front portion defined by two doors 18. Doors 18 are pivotally attached to respective lateral sides 12 by pivot pins 20, and include slates 21 which define a plurality of apertures 22 for ventilating the interior of the enclosure, particularly when the doors are in a closed position (as depicted on FIG. 4).

Figure 2:
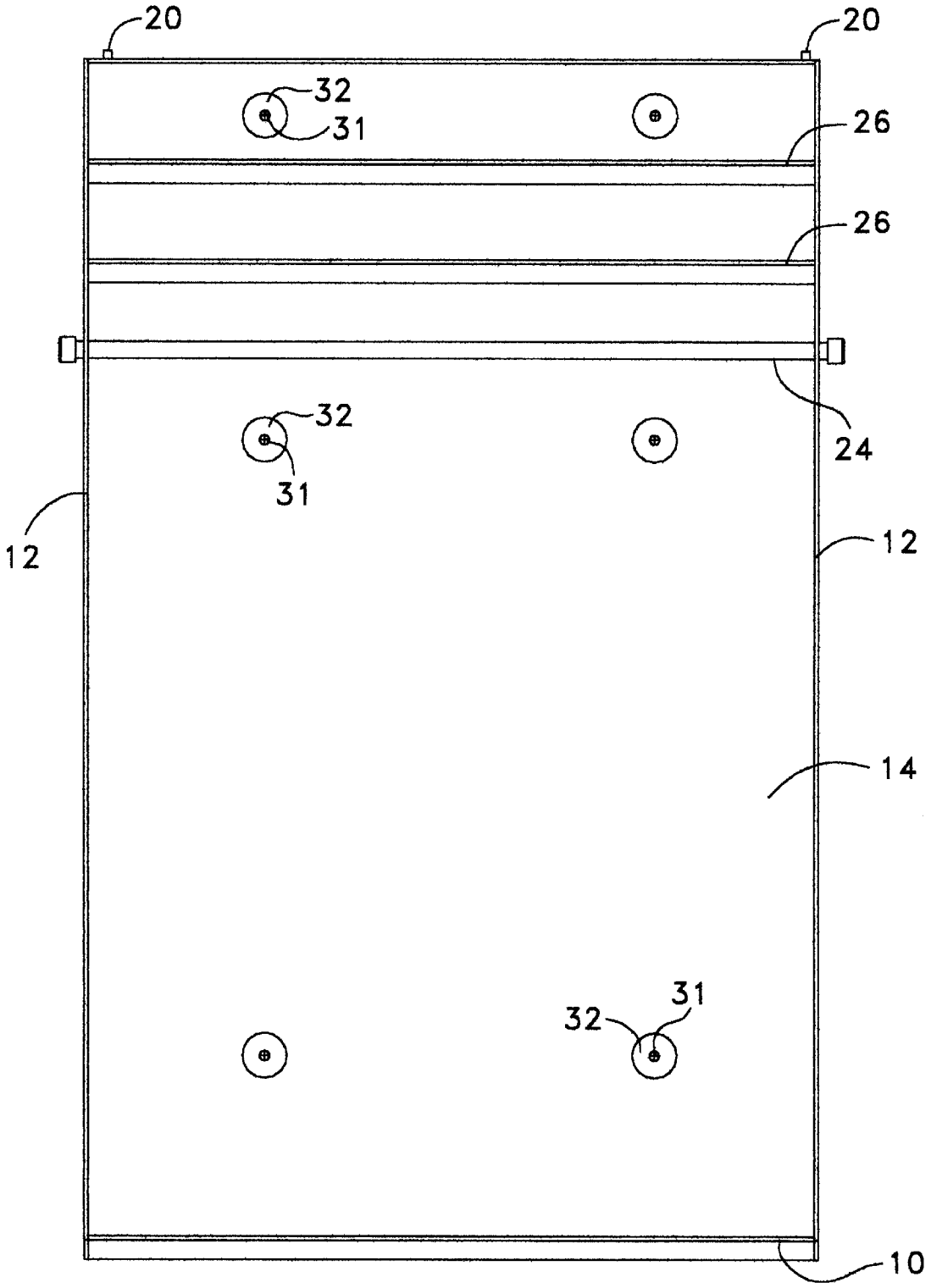
FIG. 2 is a front plan view of a portion of the device of FIG. 1.

FIG. 2 depicts a plan view of the interior of the enclosure, without the doors attached. In the form depicted, the interior includes suspending means in the form of a horizontal bar 24 extending through lateral sides 12 upon which articles of clothing may be hung for drying. Also included in the device depicted are two shelves 26 disposed above bar 24 for conveniently storing items such as dry clothing, cleaning materials, etc. Absorption material 28 (FIG. 3 only) in the form a swatch of sponge-like or other water-absorbing material is also disposed on an upper interior surface 30 of bottom plate 10. Preferably, material 28 may be removed from the enclosure to be squeeze-dried and cleaned, if necessary. Water or other liquid which drops from wet clothing hung on bar 24 is absorbed by material 28. Air ventilated into the enclosure via apertures 22 over time contacts material 28, vaporizes the absorbed liquid and carries away the liquid vapor.

Figure 4:
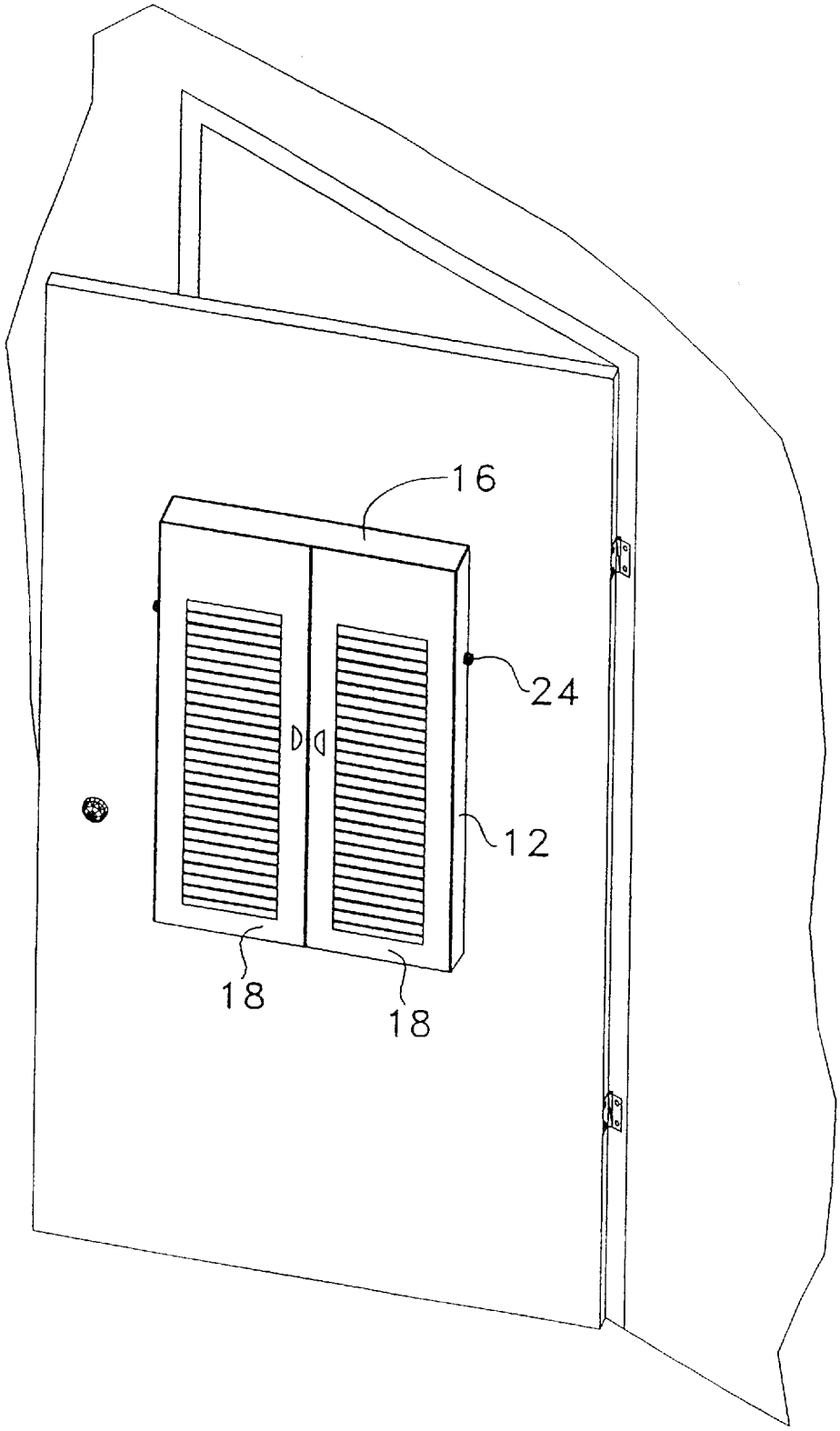
FIG. 4 is a view in perspective of the device of FIG. 1 installed on a household door.

Attachment means in the form of a plurality of screws 31 and washers 32 are provided for attaching the enclosure to a suitable substantially vertical surface, e.g., a bathroom door as depicted on FIG. 4. It is preferred that portions of rear plate 14 surrounding the necessary apertures for receiving the screws be raised from the surrounding interior surface of plate 14. In this way, water or other fluid may fall onto and run down the interior surface of plate 14 without leaking into the apertures through which screws 31 extend. As an alternative, flush mounting may also be used to attach the enclosure to a substantially vertical surface, e.g., an interior wall, to preserve space within a given room. In such case, the attachment means may be disposed around the periphery of the enclosure for attachment to surrounding wall materials.

Figure 3:
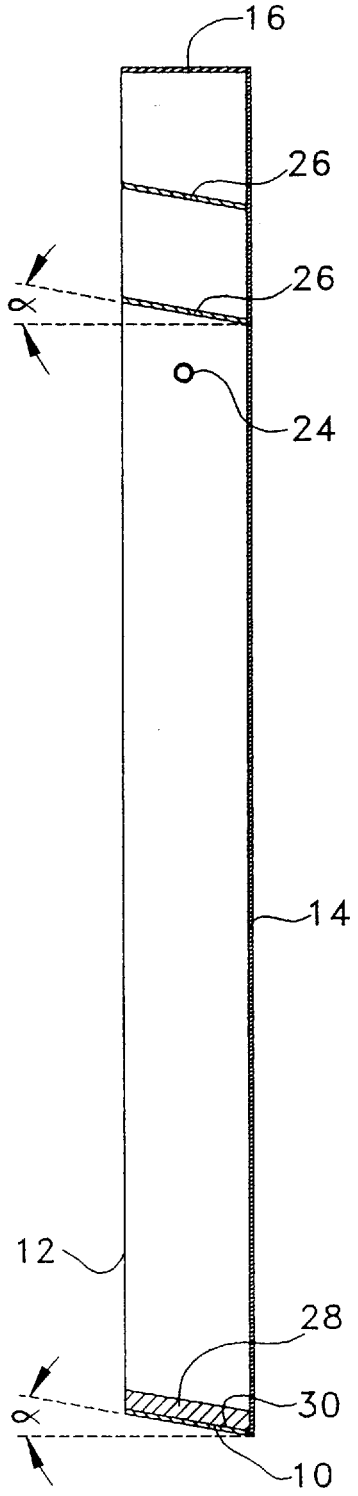
FIG. 3 is a cross-section view of a portion of the device of FIG. 1.

As seen on FIG. 3 plate 10 and upper surface 30 are disposed in a plane at an angle $\alpha$ above a plane perpendicular to rear plate 14. Plate 10 is attached to lateral sides 12 at angle $\alpha$ so that, during normal use, at least a portion of upper surface 30 occupies a non-horizontal plane to deter built-up moisture in material 28 on surface 30 from leaking out of the enclosure and onto the ground below. In preferred embodiments, angle $\alpha$ is within the range of about 5° to about 30°, most preferably in the range of about 5° to about 15°. A variety of different configurations for the bottom portion of the enclosures of this invention may be used, including surfaces grooves, rims, etc., so long as they deter the movement of excess water out of the enclosure and onto the floor (or ground) below. FIG. 3 also illustrates that shelves 26 are disposed in a similar angular fashion as compared to bottom plate 10. In this way, shelves 26 act to deter items which have been stored therein from falling out of the container when doors 18 are in an open position or when the enclosure at times undergoes sudden motion, as for example when the enclosure is attached to a door. It should also be noted that the shelve 26 most proximate to bottom plate 10 is sized to be flush with doors 18 when in a closed position, so as provide a water barrier to substantially shield items stored in the shelves from moisture below the shelves and within the enclosure.

Those skilled in the art will appreciate that the doors shown here for illustrative purposes may be substituted with a variety of other configurations, so long as each configuration provides a front portion to the enclosure of this invention. Preferably, the front portion may be opened to permit access to the interior of the enclosure, and closed to substantially conceal the contents of the enclosure. Even more preferably, the front portion should be equipped to define apertures for the ventilation of air into and out of the enclosure. In a particularly preferred embodiment, apertures are provided in the doors at positions in vertical proximity to the clothing within the container, and are not present in the doors at positions above the lowest storage shelf optionally provided above the clothing suspending means within the enclosure. In addition, any such shelf is sized so as to meet flush with the doors when in a closed position, to substantially seal the space above the lowest shelf from moisture within the enclosure below. As one skilled in the art will readily appreciate, however, the other parts of the enclosure which define part of the interior, such as the lateral sides or the rear portion, may also define apertures for the ventilation of air into and out of the enclosure.

It will also be appreciated by those skilled in the art that the doors of this device may be equipped with a variety of handles, knobs, recesses, etc. for opening and/or closing the doors, and these doors may be equipped with latches or locks to prevent unauthorized access to the contents of the enclosure. Additionally, drawers may be provided within the enclosure or as an attachment to the enclosure for additional storage.

The suspending means of this invention may include a variety of different mechanisms for suspending clothing so that it is permitted to dry through exposure to moving air. Non-limiting examples of suitable suspending means include one or more hooks, suspended clamps, bars, retractable cords, and the like, with at least one substantially horizontal bar being preferred.

The absorption means of this invention can be any material which may be cut into sections or swatches, and which is capable of absorbing water. Non-limiting examples of suitable material includes synthetic sponge, natural sponge, natural and/or synthetic fiber fabric, paper towels and other paper products, and the like. Preferably, the material used is mold-resistant and reusable after proper cleaning and drying.

The attachment means of this invention may also include a variety of different mechanisms for attaching the enclosure to a substantially vertical surface. Non-limiting examples of suitable attachment means include, suction cups, clamps, hooks, screw and washer sets, nut and bolt sets, glues and other adhesive materials, and the like. The surface to which the enclosure is attached may be indoor or even outdoor, and may include, for example, walls, doors, shower stalls, tiled surfaces around bathtubs, and the like. In preferred embodiments, the enclosure is attached to an interior wall surface, such as a bathroom or bedroom wall or door, by one or more screw and washer sets.

The ventilation provided to enclosures of this invention may be in the form of forced air, e.g., electric fans, or preferably unforced air which circulates through apertures defined by the enclosure itself. Enclosures in accordance with this invention may be fabricated using a variety of dimensions and materials, depending in large part upon the desired size of the container, and the surrounding conditions to which the enclosure will be exposed. However, with regard to dimension, to facilitate use of the enclosure on doors, small bathroom walls, and the like, the lower vertical interior distance defined by the distance between the bottom portion and the suspending means of this invention in particularly preferred embodiments is within the range of about 28 to about 36 inches, to provide sufficient space for hanging and drying of hosiery and other articles of clothing within the enclosure. Likewise, when storage space is provided above the suspended clothing, the upper vertical interior distance as defined by the distance between the top of the interior space down to the top of the suspending means of this invention is most preferably in the range of about 8 to about 15 inches. Thus, the ratio between the lower vertical distance and the upper vertical distance is most preferably in the range of about 1.9 to about 4.5. In addition, the horizontal distance or width between the lateral interior walls of the enclosure is most preferably within the range of about 19 to about 30 inches to provide sufficient interior space for the clothing to be dried, while permitting attachment of the enclosure to one side or the other of conventional household doors.

Various woods, metals, plastics, or mixtures of any two or more of these materials may be used to fabricate all or portions of the enclosure. Water resistant or water proof materials are preferred, such as treated wood, water-resistant metals including aluminum, stainless steel, and other metal alloys. Plastic materials, however, are particularly preferred for their durability under wet conditions and ease of use in manufacture.

This invention is susceptible to considerable variation in its practice. Therefore, the foregoing description is not intended to limit, and should not be construed as limiting, the invention to the particular exemplifications presented hereinabove. Rather, what is intended to be covered is as set forth in the ensuing claims and the equivalents thereof permitted as a matter of law. In the claims, means-plus-function clauses are intended to cover the structures described herein as performing the cited function and not only structural equivalents but also equivalent structures.

What is claimed is:

1. An enclosure for drying articles of clothing, the enclosure comprising a bottom portion; suspending means disposed above the bottom portion for hanging the articles of clothing within the enclosure; absorption means which, during normal use, is disposed above the bottom portion and below the articles of clothing when hung within the enclosure, for absorbing liquid which may drop from the articles of clothing when wet; and attachment means for attaching the enclosure to a substantially vertical surface; wherein the bottom portion comprises an upper surface at least a portion of which extends through a plane which is at an angle from horizontal; whereby the articles of clothing may be stored to dry while remaining substantially concealed within the enclosure.

2. An enclosure according to claim 1 wherein the suspending means comprises a cylindrical bar substantially horizontally disposed within the enclosure and above the bottom portion.

3. An enclosure according to claim 1 wherein the bottom portion comprises an upper surface, and wherein the absorption means comprises a removable swatch of water-absorbing material placed upon the upper surface of the bottom portion.

4. An enclosure according to claim 1 wherein the attachment means comprises one or more sets of washers and screws which, when in use, extend through respective apertures in the enclosure and into the substantially vertical surface.

5. An enclosure according to claim 1 wherein the suspending means comprises a cylindrical bar substantially horizontally disposed within the enclosure and above the bottom portion.

6. An enclosure according to claim 5 wherein the absorption means comprises a removable swatch of water-absorbing material disposed upon the upper surface of the bottom portion.

7. An enclosure according to claim 6 wherein the attachment means comprises one or more sets of washers and screws, the screws when in use extending through respective apertures in the enclosure and into the substantially vertical surface.

8. An enclosure according to claim 7 further comprising a front portion and two lateral sides, and wherein the front portion comprises one or more doors, each of the doors having a hinge side pivotally hinged to a respective lateral side of the enclosure so that, when in a closed position, the doors extend between the lateral sides to substantially conceal the contents of the enclosure.

9. An enclosure according to claim 8 wherein the doors are characterized in that they define apertures extending through a portion of the enclosure for supplementing the ventilation of air within the enclosure.

10. An enclosure according to claim 9 further comprising one or more shelves extending between the lateral sides and above the suspending means.

11. An enclosure according to claim 10 wherein the enclosure is fabricated from a water-resistant material.

12. An enclosure according to claim 1 wherein the enclosure is fabricated from a water-resistant material.

13. An enclosure according to claim 1 further comprising a front portion and two lateral sides, and wherein the front portion comprises one or more doors, each of the doors having a hinge side pivotally hinged to a respective lateral side of the enclosure so that, when in a closed position; the doors extend between the lateral sides to substantially conceal the contents of the enclosure.

14. An enclosure according to claim 13 wherein the doors are characterized in that they define one or more apertures extending through a portion of the enclosure for supplementing the ventilation of air within the enclosure.

15. An enclosure according to claim 14 further comprising one or more shelves extending between the lateral sides and above the suspending means.

16. An enclosure according to claim 15 wherein the enclosure is fabricated from a water-resistant material.

17. A method of drying articles of clothing, the method comprising (a) placing the articles of clothing in an enclosure, the enclosure comprising a bottom portion, suspending means disposed above the bottom portion, absorption means below the suspending means and above the bottom portion, and attachment means for attaching the enclosure to an interior surface; (b) suspending the articles of clothing from the suspending means of the enclosure; (c) supporting the absorption means on an upper surface of the bottom portion of the enclosure at least a portion of the upper surface extending through a plane at an angle from horizontal; and (d) concealing the articles of clothing within the enclosure.

18. A method according to claim 17 wherein the absorption means comprises a removable swatch of water-absorbing material.

19. A method of drying articles of clothing which comprises suspending the articles over an elevated, water absorption material in the presence of moving air such that (i) moisture from the articles is allowed to drop to the material and to be absorbed thereby, and (ii) moving air contacting the material vaporizes absorbed water therefrom and removes the resultant water vapor from proximity to the articles; and supporting the water absorption material on a surface at least a portion of which extends through a plane which is at an angle from horizontal to thereby prevent excess water or other liquid from running off of the surface during normal use.

20. A method according to claim 19 wherein the articles, when suspended, are contained by an enclosure which also contains the water absorption material and wherein the method further comprises concealing the articles of clothing in the enclosure from the view of passersby.

* * * * *